US005813709A

United States Patent [19]

Umino

[11] Patent Number: 5,813,709

[45] Date of Patent: Sep. 29, 1998

[54] VEHICLE DOOR LATCH DEVICE

[75] Inventor: Masaaki Umino, Yamanashi-ken, Japan

[73] Assignee: Mitsui Kinzoku Kogyo Kabushiki Kaisha, Tokyo, Japan

[21] Appl. No.: 674,511

[22] Filed: Jul. 2, 1996

[30] Foreign Application Priority Data

Jul. 3, 1995 [JP] Japan ..... 7-189869

[51] Int. Cl.[6] ..... E05C 3/06

[52] U.S. Cl. ..... 292/216; 292/337; 292/DIG. 23

[58] Field of Search ..... 292/201, 216, 292/DIG. 23, DIG. 27, DIG. 65, DIG. 41, 337

[56] References Cited

U.S. PATENT DOCUMENTS

| | | | |
|---|---|---|---|
| 3,709,537 | 1/1973 | Kazaoka et al. | 292/DIG. 41 X |
| 4,382,622 | 5/1983 | Ishikawa | 292/216 |
| 4,905,532 | 3/1990 | Fukumoto et al. | 295/201 X |
| 4,934,748 | 6/1990 | Hayakawa et al. | 292/337 |
| 4,948,183 | 8/1990 | Yamada | 292/216 X |
| 4,995,654 | 2/1991 | Nishigami et al. | 292/216 |

FOREIGN PATENT DOCUMENTS 63-170125 7/1988 Japan .

*Primary Examiner*—Rodney M. Lindsey
*Attorney, Agent, or Firm*—Browdy and Neimark

[57] ABSTRACT

A vehicle door latch device comprises a latch body, a metal back plate fixed to a rear side of the latch body, a locking mechanism provided on the rear side of the latch body and displaceable between a locked condition and an unlocked condition. The locking mechanism has a main lock lever which has a base part rotatably mounted to the back plate and an inner part extending toward an interior side of the vehicle door so as to be connected to an inside lock button, and a sub lock lever which has a base part rotatably mounted to the back plate and an outer part extending toward an exterior side of the door so as to be connected to a key cylinder. The back plate has a protecting part located on a front side of the outer part of the sub lock lever so as to prevent the outer part of the sub lock lever from making contact with the main lock lever when the outer part of the sub lock lever is deformed.

12 Claims, 6 Drawing Sheets

VEHICLE DOOR LATCH DEVICE

BACKGROUND OF THE INVENTION

The present invention relates to a vehicle door latch device, in particular, to a door latch device which can restrain a lock lever from falling into an inoperative condition.

PRIOR ART OF THE INVENTION

A prior art door latch device has a lock lever which is connected to a door key cylinder and an inside lock button of a vehicle door, and which is displaceable between a locked position and an unlocked position. It has been known that the lock lever cannot be displaced due to a fixed contact between an outer end of the lock lever and an outer panel of the door deformed by a traffic accident. Thus, the driver is usually instructed so that the lock lever is held at the unlocked position during the driving.

Japanese Patent Laid-Open No. 63-170125 discloses a door latch device which has a metallic cover for surrounding and protecting a lock lever so that the lock lever can be substantially prevented from making contact with a deformed outer door panel. However, should the outer panel be deformed by a large degree, the protecting cover would be also deformed and be in contact with the lock lever. Thus, the lock lever falls into the inoperative condition. Further, since the protecting cover bulges outward by a large degree so as to surround the lock lever, the overall size of the latch device is large.

FIG. 16 shows another prior art door latch device provided with a lock lever which is composed of a main lock lever a extending toward an interior side of the vehicle so as to be connected to an inside lock button B and a sub lock lever (key lever) C extending toward an exterior side so as to be connected to a key cylinder D. In this latch device, the main lock lever A can be substantially prevented from making direct contact with an outer door panel E even though the outer panel E is deformed by a large degree. However, the sub lock lever C which is in contact with and deformed by the outer panel E will hinder motion of the main lock lever A.

SUMMARY OF THE INVENTION

Accordingly, one object of the present invention is to provide a door latch device which can restrain a lock lever coupled to an inside lock button from falling into an inoperative condition even though the door is deformed.

DESCRIPTION OF THE PREFERRED EMBODIMENTS

Figure 1:
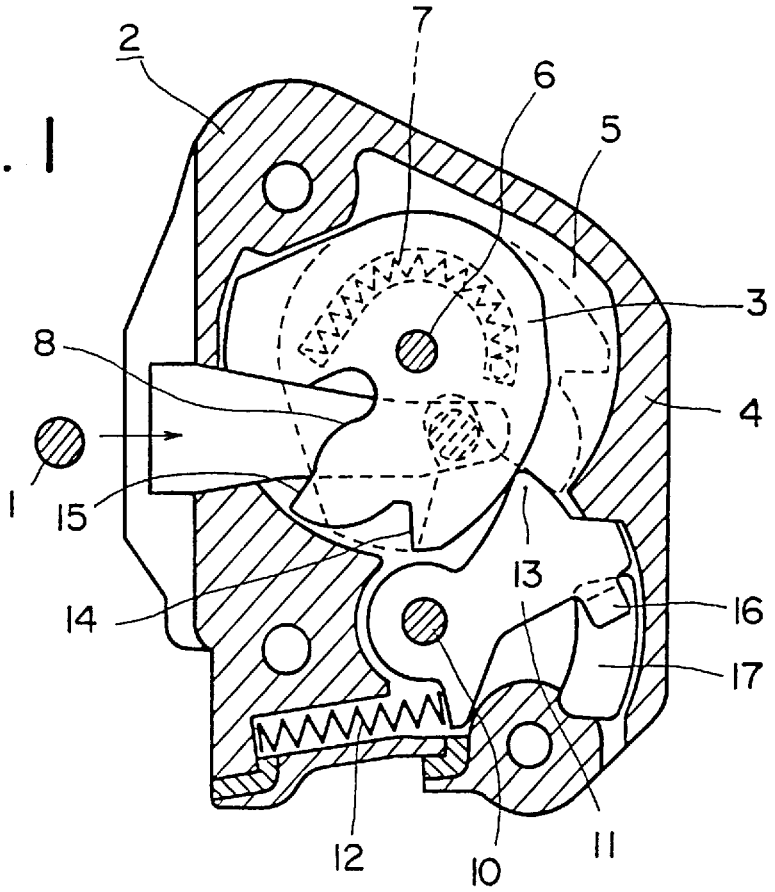
FIG. 1 is a front view showing a door latch device according to the present invention.
Figure 16:
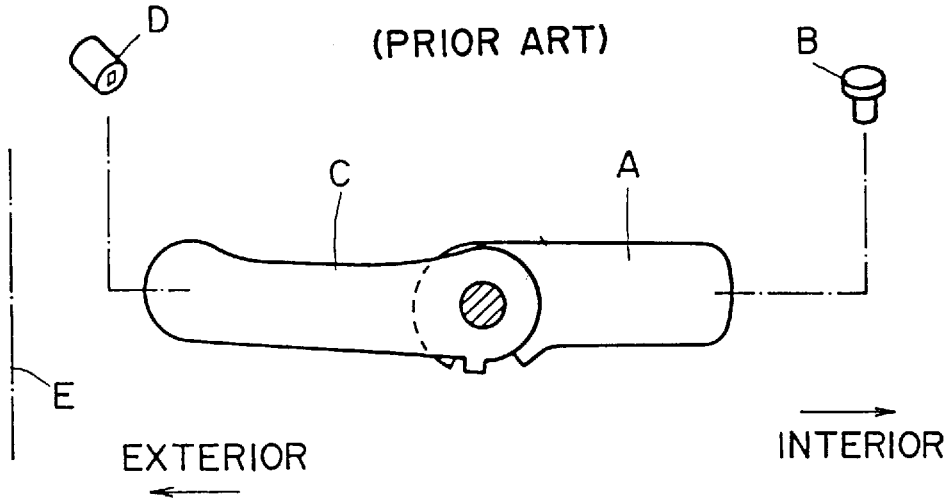
FIG. 16 (PRIOR ART)
FIG. 16 is a view illustrating a conventional example.

Explanation will be hereinbelow made of an embodiment of the present invention with reference to the drawings. A latch device 2 according to the present invention comprises a latch 3 which is engagable with a striker 1 fixed to a vehicle body, and a ratchet 11 for holding the engagement between the latch 3 and the striker 1. The latch 3 and the ratchet 11 are rotatably received in a recess 5 formed in a synthetic latch body 4 by means of a latch shaft 6 and a ratchet shaft 10, respectively. The latch 3 is urged clockwise, as viewed in FIG. 1, by the resilient force of a spring 7, and the ratchet 11 is urged counterclockwise by the resilient force of a spring 12.

The latch 3 is turned counterclockwise against the resilient force of the spring 7 when the striker 1 is engaged with a fork part 8 of the latch 3, and the latch device 2 falls into a half-latch condition when a pawl part 13 of the ratchet 11 is engaged with a half-latch step part 14 of the latch 3 while it falls in a full-latch condition when the pawl part 13 is engaged with a full-latch step part 15 of the latch 3.

The ratchet 11 has a protrusion 16 which projects into the rear side of the body 4 through an opening 17 of the latch body 4. As the protrusion 16 is moved downward by an opening operation of a door opening mechanism described hereinbelow, the ratchet 11 is separated from the latch 3 so as to open the door.

Figure 2:
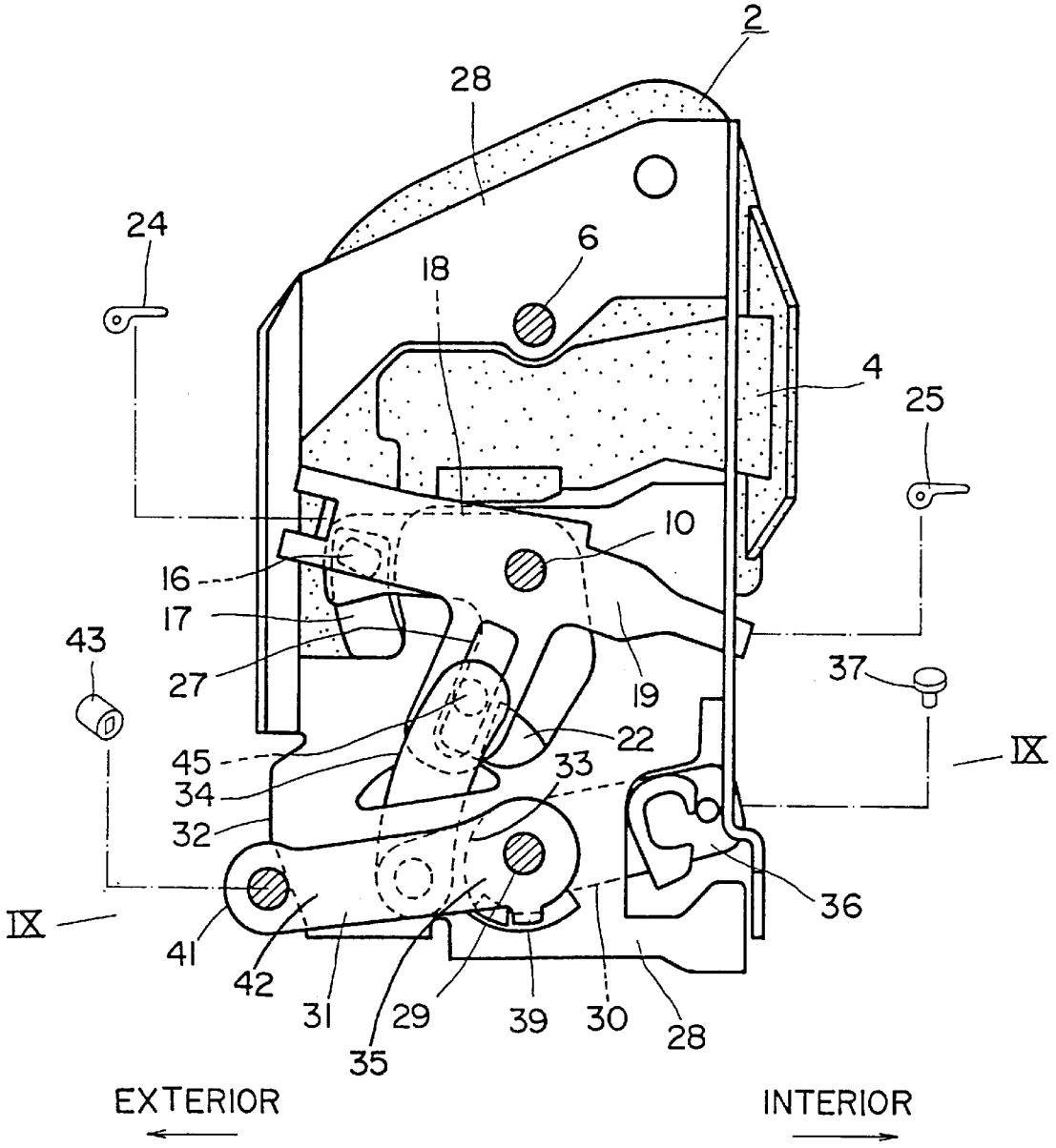
FIG. 2 is a rear view showing the door latch device.
Figure 7:
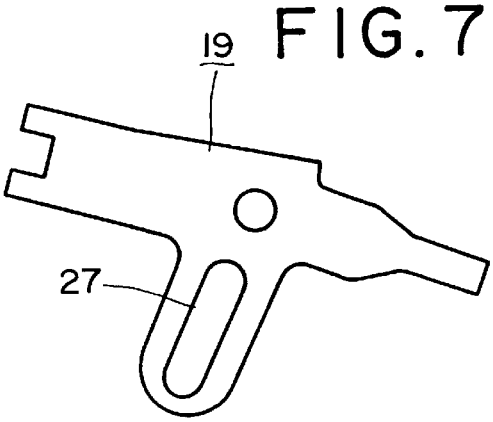
FIG. 7 is a front view of an open lever.
Figure 8:
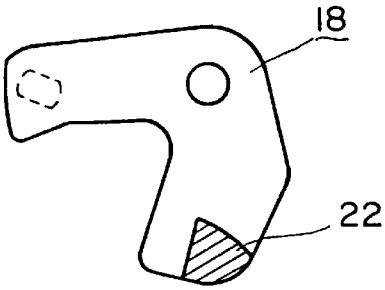
FIG. 8 is a front view of a ratchet lever.

FIG. 2 shows the door opening mechanism and a locking mechanism, both of which is provided on the rear side of the latch body 4. The opening mechanism has a ratchet lever 18 (FIG. 8) which is connected to the protrusion 16, an open lever 19 (FIG. 7) which is turned by an operation of an outer open handle 24 and/or an inner open handle 25. The levers 18 and 19 are rotatably supported to the ratchet shaft 10.

The open lever 19 has an elongated hole 27 in which a pin 45 of the locking mechanism is slidably engaged. The pin 45 is opposed to a protrusion 22 of the ratchet lever 18 when the locking mechanism is in an unlocked condition. Therefore, under the unlocked condition, the opening operation of the open handle 24 or 25 causes the pin 45 to push the protrusion 22, to thereby rotate the ratchet lever 18 and the ratchet 11 so as to open the door. Oppositely, under a locked condition, the pin 45 is separated from the protrusion 22, therefore, the pin 45 cannot push the protrusion 22 even though the open handle 24 or 25 is manipulated for opening the door.

Figure 15:
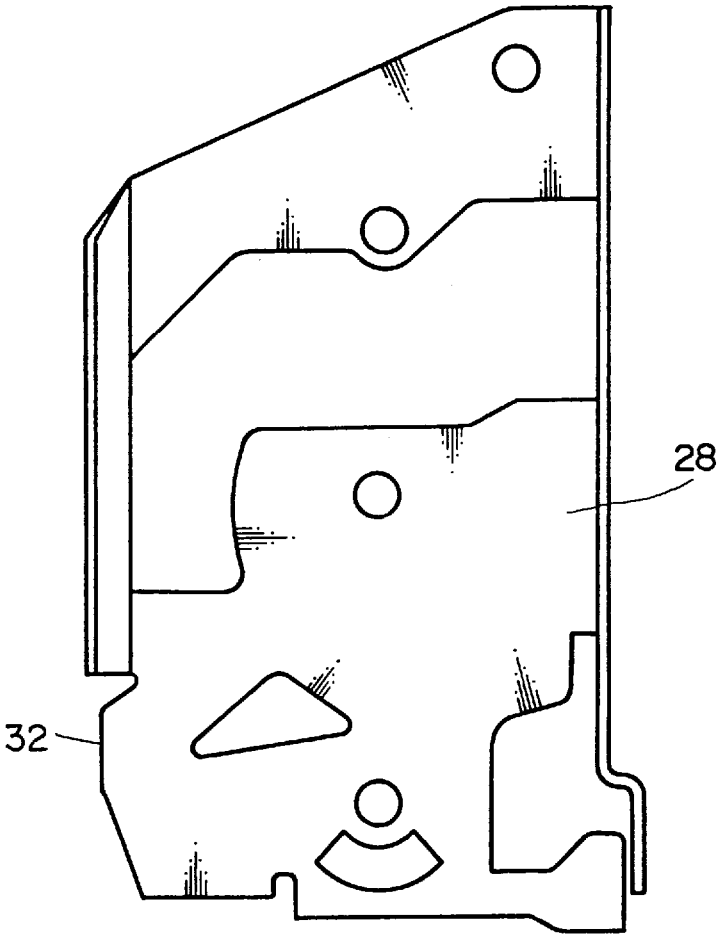
FIG. 15 is a front view of a back plate.

A metal back plate 28, as shown in FIGS. 2 and 15, is secured to the rear side of the latch body 4. The ratchet lever 18 and the open lever 19 are located on the rear side of the back plate 28.

Figure 3:
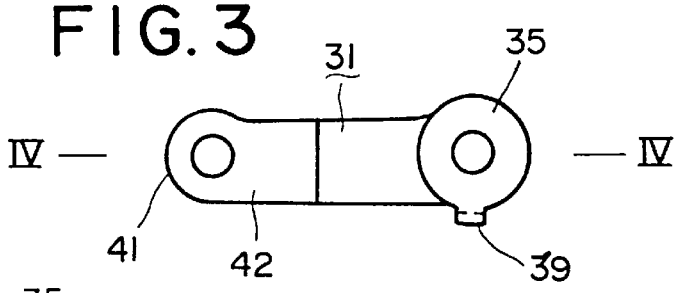
FIG. 3 is a front view of a sub lock lever or a key lever.
Figure 4:
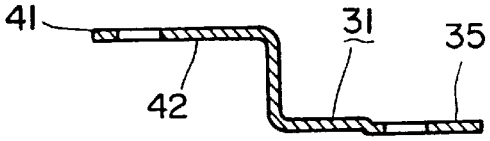
FIG. 4 is a sectional view taken along IV—IV line shown in FIG. 3.

The locking mechanism has a main lock lever 30 (FIGS. 5 and 6) to be coupled to an inside lock button 37, and a sub lock lever or a key lever 31 (FIGS. 3 and 4) to be coupled to a door key cylinder 43. A base part 33 of the lock lever 30 and a base part 35 of the key lever 31 are rotatably attached to the back plate 28 by means of a rivet 29. An inner part 36 of the lock lever 30 extends from the base part 33 toward the interior side of the vehicle so as to be coupled to the lock button 37, and an outer part 42 of the key lever 31 extends from the base part 35 toward the exterior side so as to be coupled to the door key cylinder 43.

Figure 5:
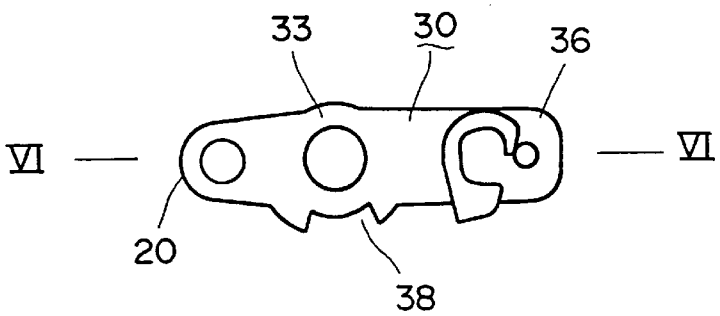
FIG. 5 is a front view of a main lock lever.
Figure 6:
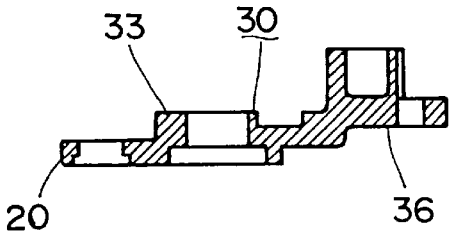
FIG. 6 is a sectional view taken along VI—VI line shown in FIG. 5.

A link 34 is connected at its one end to the lock lever 30, and is provided at the other end with the pin 45. A recess 38 is formed in the base part 33 of the lock lever 30, as shown in FIG. 5, and a bent part 39 of the key lever 31 is engaged with the recess 38 with a lost-motion.

Figure 9:
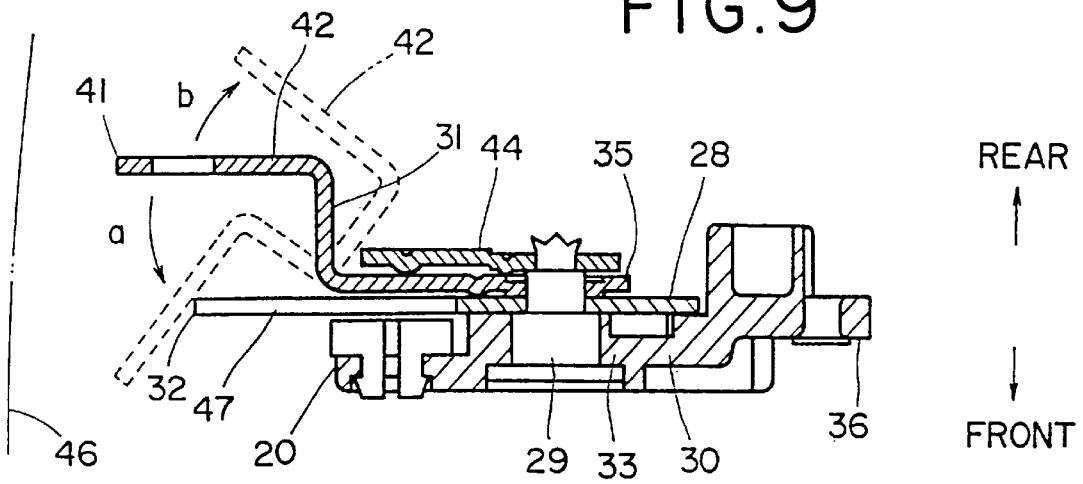
FIG. 9 is a sectional view taken along IX—IX line shown in FIG. 2.

FIG. 9 shows a first embodiment in which the lock lever 30 is located on the front side of the back plate 28, and the key lever 31 is located on the rear side of the back plate 28. A-sub plate 44 is arranged on the rear side of the key lever 31. An outer edge 32 of the back plate 28 is projected toward the exterior side beyond an outer end 20 of the lock lever 30. An outer end 41 of the key lever 31 is projected toward the exterior side beyond the outer edge 32 of the back plate 28. A part 47 of the back plate 28 which is projected toward the exterior side beyond the outer end 20 of the lock lever 30 serves as a protecting part for the lock lever 30.

In the first embodiment shown in FIG. 9, when an outer panel 46 of the door is deformed by a traffic accident, the outer end 41 of the key lever 31 will be pushed by the outer panel 46 and be deformed as indicated by dotted lines. Even if the outer part 42 is bent toward the lock lever 30 as indicated by the arrow a, the protecting part 47 prevents the outer part 42 of the key lever 31 from making contact with the lock lever 30. Further, even though the base part 35 of the key lever 31 is happenedly deformed, the possibility of occurrence of such a risk that the lock lever 30 falls into an inoperative condition is extremely small since the base part 35 is isolated from the lock lever 30 by means of the back plate 28. Further, as the outer edge 32 of the back plate 28 does not extend beyond the outer end 41 of the key lever 31, the latch device 2 can have a small size.

Figure 10:
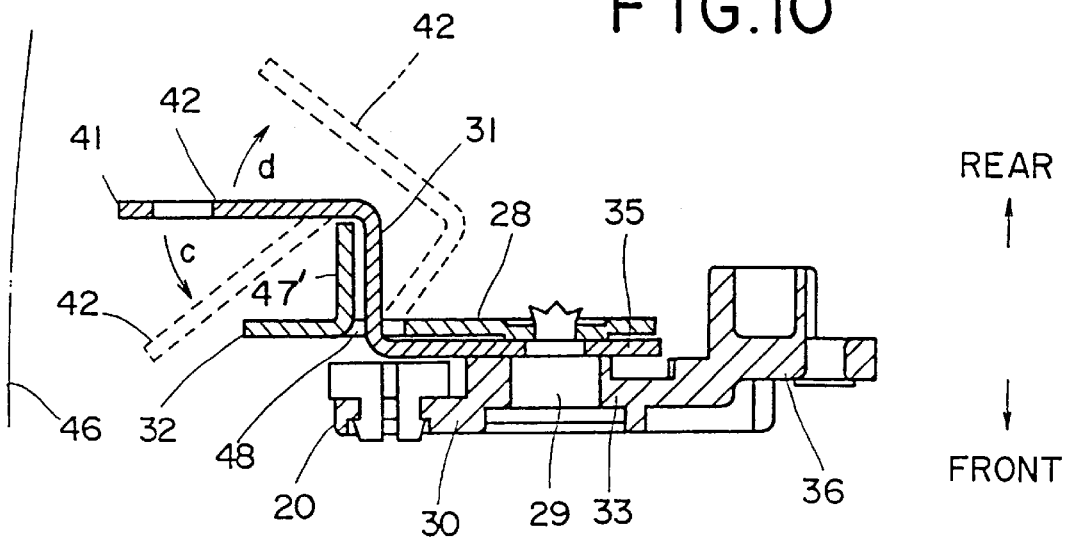
FIG. 10 is a sectional view showing a second embodiment of the present invention.

FIG. 10 shows a second embodiment of the present invention in which the base part 33 of the lock lever 30 is arranged adjacent to the base part 35 of the key lever 31. The outer part 42 of the key lever 31 is projected into the rear side of the back plate 28 through an opening 48 of the plate 28 so that the protecting part 47' is located on the front side of the outer part 42. The protecting part 47' of the second embodiment is bent so as to be in parallel with the axis of the rivet 29.

In the second embodiment, the outer part 42 of the key lever 31 will be deformed as indicated by the arrow c or d by the deformed panel 46. However, similar to the first embodiment, the protecting part 47' prevents the outer part 42 from abutting against the lock lever 30. Further, in the second embodiment, even if the outer part 42 is deformed as indicated by the arrow c, the protecting part 47' satisfactorily prevents the base part 35 from being deformed, therefore, the base part 33 of the lock lever 30 can be arranged adjacent to the base part 35 of the key lever 31. Accordingly, the sub plate 44 shown in FIG. 9 is not required.

Figure 12:
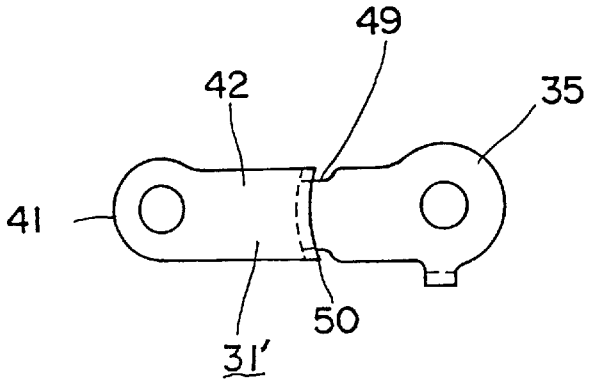
FIG. 12 is a front view of another type of the sub lock lever.
Figure 13:
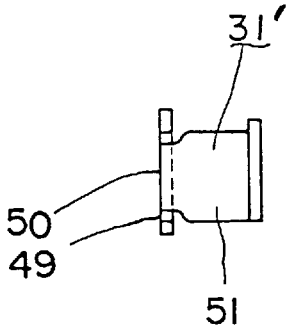
FIG. 13 is a side view of the sub lock lever shown in FIG. 11.
Figure 14:
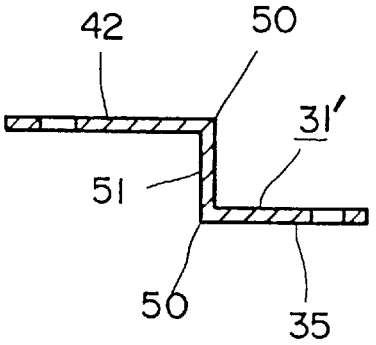
FIG. 14 is a sectional view of the sub lock lever shown in FIG. 11.

FIGS. 12 to 14 show another type of the key lever 31'. It is desired that the key lever 31' does not hinder the movement of the lock lever 30 even if it is deformed upon occurrence of an accident or the like. The key lever 31' has at least one cutout portion 49 for lowering the strength thereof so that the deformed configuration of the key lever 31' by an external force can be controlled. The cutout portion 49 is formed in a portion 51 for connecting the base part 35 with the outer part part 42, or in a bent portion 50 between the outer part 42 and the connecting part 51.. Further, the cutout portion 49 is positioned on the exterior side of the outer end 20 of the lock lever 30. With this arrangement, an external force which is exerted to the key lever 31 due to the accident or the like, is absorbed by the cutout portion 49, and is not transmitted substantially to the base part 35 of the key lever 31'.

Figure 11:
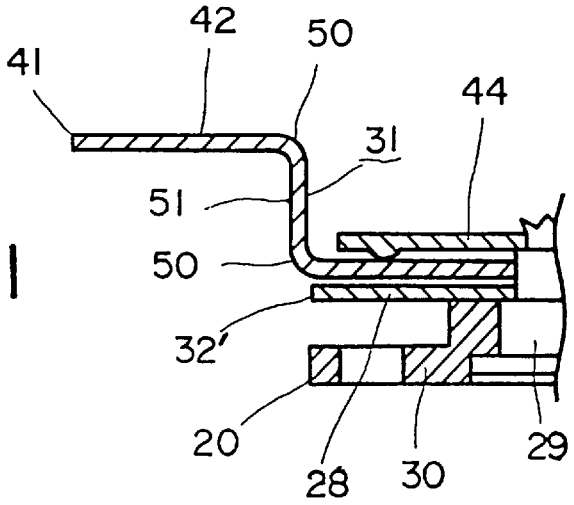
FIG. 11 is a sectional view showing a third embodiment of the present invention.

Further, the cutout portion 49 can be arranged on the exterior side of the outer edge 32' of the back plate 28 as shown in FIG. 11. In this case, the back plate 28 can be formed to be small-sized.

What is claimed is:

1. A vehicle door latch device for use with a vehicle door engaged on a vehicle body comprising:

a latch body for accommodating a latch to be engaged with a striker of the vehicle body and a ratchet to be engaged with the latch for holding the engagement between the latch and the striker;

a door opening mechanism provided on a rear side of the latch body for releasing the engagement between the latch and the striker;

a locking mechanism provided on the rear side of the latch body and displaceable between a locked condition for disabling an opening operation of the door opening mechanism and an unlocked condition for enabling the opening operation of the door opening mechanism;

a metal back plate (28) fixed to the rear side of the latch body;

said locking mechanism having a main lock lever (30) and a sub lock lever (31);

said main lock lever (30) having a base part (33) which is rotatably mounted to the back plate by a supporting shaft (29) and an inner part (36) which is adapted to extend from the base part (33) to an interior side of the vehicle door and is adapted to be connected to an inside lock button (37) of the vehicle door, said main lock lever being located on a front side of the back plate (28);

said sub lock lever (31) having a base part (35) which is rotatably mounted to the back plate (28) by the supporting shaft (29) and an outer part (42) which is adapted to extend from the base part to an exterior side of the vehicle door and is adapted to be connected to a key cylinder of the vehicle door;

said back plate having a protecting part located on a front side of the outer part of the sub lock lever so as to prevent the outer part of the sub lock lever from making contact with the main lock lever when the outer part of the sub lock lever is deformed.

2. The device as set forth in claim 1, wherein said outer part of the sub lock lever has an outer end which is adapted to project toward the exterior side of the vehicle door beyond an outer edge of the back plate.

3. The device as set forth in claim 1, wherein said back plate is sandwiched between the base part of the main lock lever and the base part of the sub lock lever.

4. The device as set forth in claim 2, wherein said protecting part (47) is bent so as to be in parallel with an axis of the supporting shaft (24).

5. The device as set forth in claim 1, wherein said base part of the sub lock lever is located on the front side of the back plate.

6. The device as set forth in claim 5, wherein said back plate (28) has an opening (48) through which the outer part of the sub lock lever (31) projects into a rear side of the back plate.

7. The device as set forth in claim 5, wherein said protecting part (47')is bent so as to be in parallel with an axis of the supporting shaft.

8. The device as set forth in claim 1, wherein said protecting part is located at a same position as that of an outer end (20) of the main lock lever or located on an exterior side of the outer end (20) of the main lock lever.

9. The device as set forth in claim 8, wherein said outer part of the sub lock lever has an outer end which is adapted to project toward the exterior side of the vehicle door beyond an outer edge of the back plate.

10. The device as set forth in claim 1, wherein said sub lock lever has a cutout portion for lowering a strength thereof between a base part and an outer part of said sub lock lever.

11. The device as set forth in claim 1, wherein said sub lock lever has two bent portions for arranging the base part and the outer part to be substantial parallel with each other, and wherein at least one of said bent portions has a cutout portion for lowering a strength of the sub lock lever.

12. The device as set forth in claim 1, wherein said sub lock lever has a connecting portion for connecting the base part and the outer part, said connecting portion being substantially orthogonal to the base part and the outer part, and wherein the connecting portion has a cutout portion for lowering a strength of the sub lock lever.

* * * * *